United States Patent [19]

Spreng

[11] Patent Number: 4,561,270

[45] Date of Patent: Dec. 31, 1985

[54] KEY OPERATED SHALLOW PENETRATION LOCK

[75] Inventor: Robert R. Spreng, Brookfield, Wis.

[73] Assignee: Briggs & Stratton Corp., Wauwatosa, Wis.

[21] Appl. No.: 558,917

[22] Filed: Dec. 7, 1983

[51] Int. Cl.[4] ..... E05B 15/14

[52] U.S. Cl. ..... 70/364 R; 70/377

[58] Field of Search ..... 70/364 R, 377, 376, 70/358, 392

[56] References Cited

U.S. PATENT DOCUMENTS

| | | | |
|---|---|---|---|
| 1,360,489 | 11/1920 | Andreáni | 70/364 R |
| 2,003,086 | 5/1935 | Liss | 70/364 R |
| 2,079,628 | 5/1937 | Olson | 70/364 R |
| 2,123,940 | 7/1938 | Gray | 70/364 R |
| 2,155,734 | 4/1939 | Olson | 70/364 R |
| 3,352,134 | 11/1967 | Lett | 70/362 |
| 3,507,133 | 4/1970 | Basseches | 70/421 |
| 3,578,371 | 5/1971 | Keller | 70/364 |
| 3,837,197 | 9/1974 | Lopez | 70/364 |
| 4,015,458 | 4/1977 | Mercurio | 70/364 |

*Primary Examiner*—Robert L. Wolfe

*Attorney, Agent, or Firm*—Andrus, Sceales, Starke & Sawall

[57] ABSTRACT

A shallow penetration, key operated lock. The lock includes an outer casing and a cylinder is mounted for rotation in the casing and is adapted to be connected through a lever assembly to a working member. The cylinder is provided with a central keyway and a locking member, such as a side bar, acts to removably lock the cylinder to the casing to prevent rotation of the cylinder. At least one pair of tumbler plates are mounted in flatwise sliding relation within the cylinder and each tumbler plate is provided with an opening which is aligned with the keyway. In addition, the tumbler plates of each pair are provided with aligned elongated openings and a spring is positioned longitudinally within the openings and bears against the respective ends of the openings. A double bitted, non-reversible key is received within the keyway and the key bits slide the tumbler plates relative to each other to move the tumbler plates into an operative position. In the operative position, the side bar is released to thereby enable the cylinder to be rotated relative to the outer casing. The springs, which also bear against shoulders formed in the cylinder, act to return the tumbler plates to a neutral key-receiving position when the key is removed from the lock.

9 Claims, 6 Drawing Figures

FIG. 3
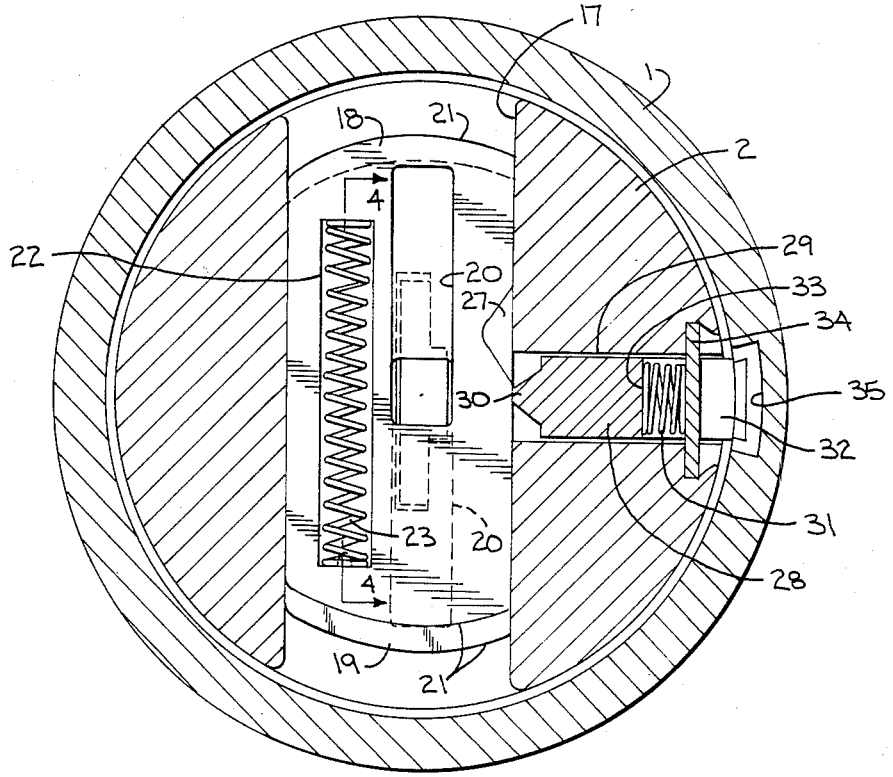
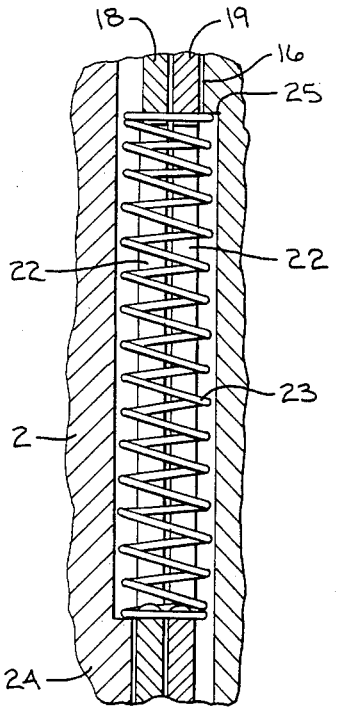
FIG. 4
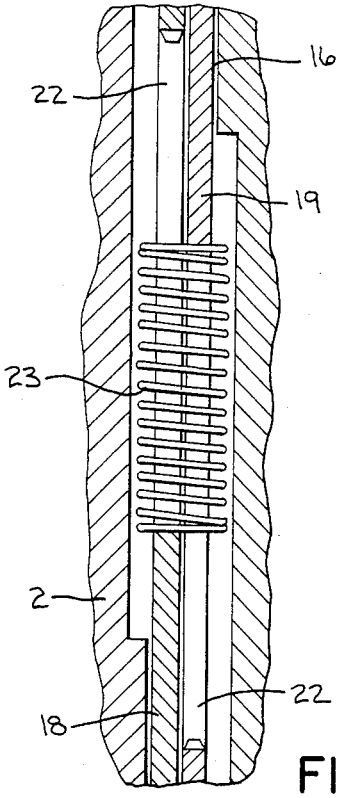
FIG. 5
FIG. 6
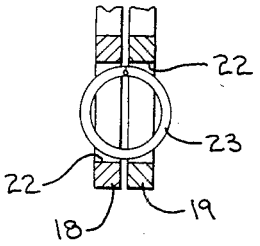

KEY OPERATED SHALLOW PENETRATION LOCK

BACKGROUND OF THE INVENTION

A conventional type of key operated lock includes a cylinder that is mounted for rotation within an outer casing, and a group of tumbler plates are positioned in series along the length of the cylinder.

In certain locks, a side bar locking member is engaged with the sides of the tumbler plate and in the locked condition, with the key removed from the lock, the side bar is engaged with a recess in the outer casing to prevent rotation of the cylinder relative to the casing. When the key is inserted in the lock, the bits on the key move each of the tumbler plates causing notches in the side edges of the tumbler plates, to mate with the inner edge of the side bar, enabling the side bar to move inwardly, out of engagement with the recess, under the influence of a spring, to thereby unlock the cylinder from the outer casing.

To obtain the necessary number of key codes, the conventional key operated lock employs a plurality of tumbler plates, with each tumbler plate being biased inwardly by a separate spring. In some cases, the spring is engaged with the outer end of the tumbler plate, while in other locks the tumbler plate is provided with a laterally extending lug or ear and the spring is engaged with the lug.

Recently, due to design changes in vehicles, the space for the conventional door lock has been substantially reduced and the tumbler plate lock will not fit within the space limitations.

SUMMARY OF THE INVENTION

The invention is directed to an improved key operated lock having security, key size, number of key codes, and weather sealing characteristics comparable to a conventional lock, but having a substantially reduced length, enabling the lock to be installed in locations where a conventional lock cannot be installed.

In the lock of the invention, two pair of tumbler plates are mounted for sliding movement within guideways in the cylinder. The plates of each pair are located in flatwise contacting relation and each tumbler plate is provided with an aperture which is aligned with the keyway in the cylinder.

To urge the tumbler plates to a neutral position, a compression spring is mounted within aligned openings in each pair of tumbler plates, with the axis of the spring extending longitudinally to the tumbler plates or normal to the keyway. The ends of the spring also engage shoulders formed in the guideways so that, on removal of the key, the spring will bias the respective tumbler plates to a neutral position where the apertures in the tumbler plates are aligned with the keyway in the cylinder.

When a double bitted, non-reversible key is inserted in the keyway the bits move the tumbler plates relative to each other, thereby compressing the respective springs and moving the tumbler plates into an operative position in which notches formed in the side edges of the plates mate with the end of a side bar locking member. With the notches aligned with the side bar, the side bar can move inwardly to thereby release the locking connection between the cylinder and the outer casing, enabling the cylinder to be rotated relative to the casing.

When the key is removed from the lock, the springs will return the tumbler plates to a neutral position in the guideways where the apertures in the tumbler plates are aligned with the keyway.

By utilizing a double bitted, non-reversible key along with tumbler plates that are in contiguous relation, the length of the lock can be reduced substantially over conventional locks.

The lock of the invention also includes a shutter which is biased across the keyway to provide a weather seal for the lock.

With the construction of the invention, the keyway is located on the center line of the cylinder and the tumbler plates can be combined with a side bar construction to lock the cylinder to the outer casing.

The lock of the invention also has improved mounting versatility and can be used with lug mounts, clip slots, wing mounts, or integrated with a door handle.

Other objects and advantages will appear in the course of the following description.

DESCRIPTION OF THE DRAWINGS

The drawings illustrate the best mode presently contemplated of carrying out the invention.

In the drawings:

FIG. 3 is a section taken along line 3—3 of FIG. 1;

FIG. 4 is a section taken along line 4—4 of FIG. 3 showing a pair of tumbler plates with the key removed from the lock;

FIG. 5 is a view similar to FIG. 4 with the key inserted in the lock; and FIG. 6 is a fragmentary transverse section showing a pair of tumbler plates and the associated spring.

DESCRIPTION OF THE ILLUSTRATED EMBODIMENT

Figure 1:
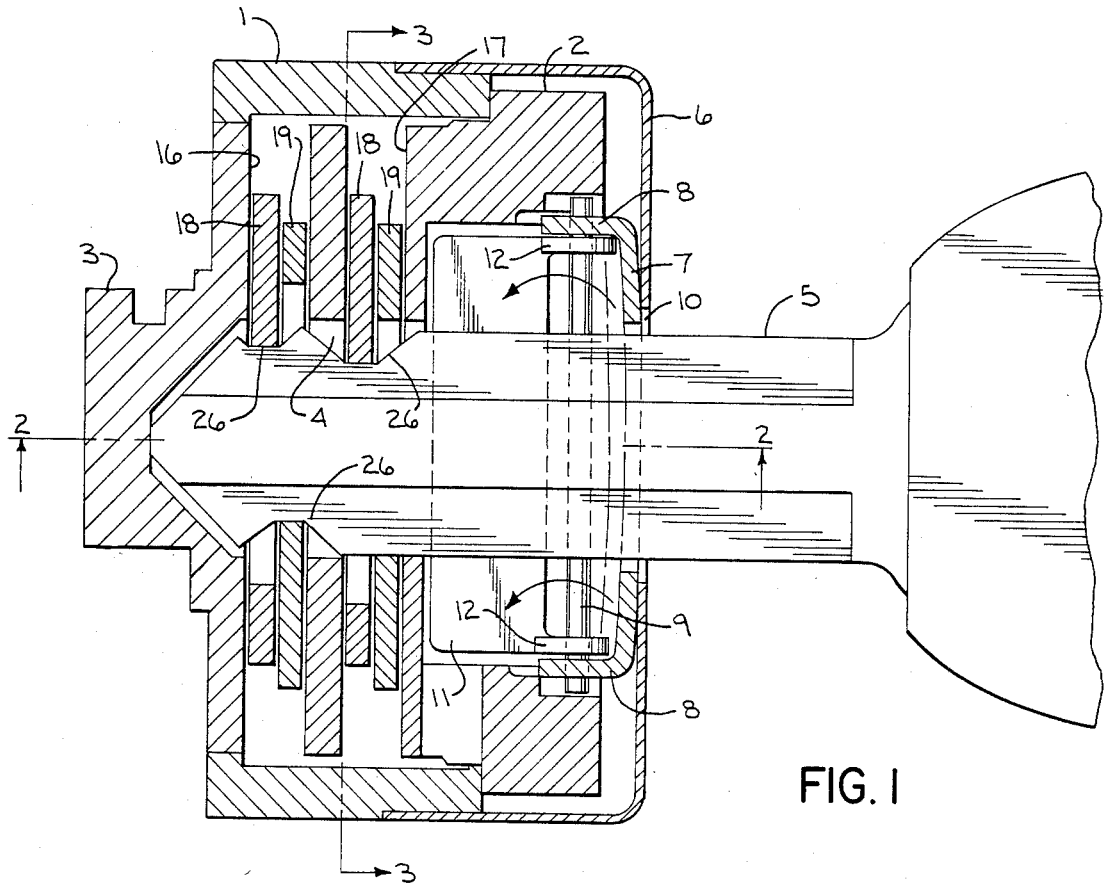
FIG. 1 is a longitudinal section of the lock of the invention with a key inserted.

The drawings illustrate a shallow penetration lock having a reduced length over conventional locks and consisting of a cylindrical outer casing 1 which surrounds a rotatable cylinder or barrel 2. The outer end 3 of the cylinder projects beyond the casing 1 and is adapted to be connected by a conventional linkage to a working member to perform a work function.

Cylinder 2 is provided with a central keyway 4 which is located along the center line of the cylinder, and a double bitted, non-reversible key 5 is adapted to be inserted within the keyway 4 to operate the lock.

Figure 2:
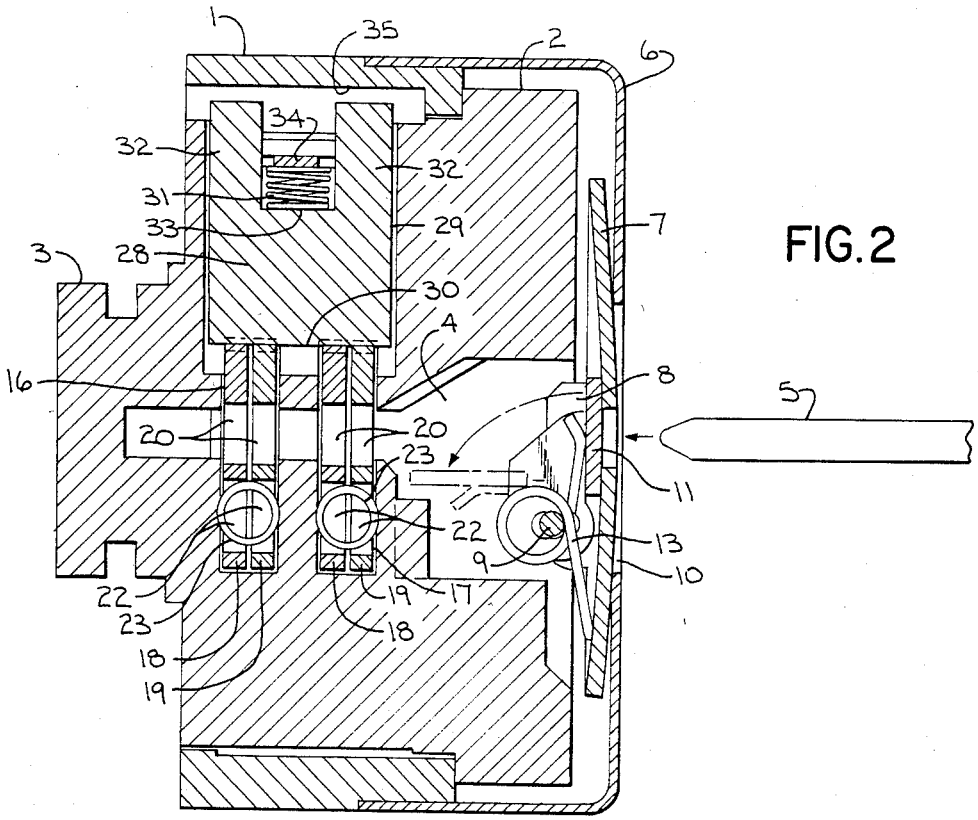
FIG. 2 is a section taken along line 2—2 of FIG. 1 with the key removed.

The outer end of casing 1 is enclosed by a cup-shaped case cap 6, and a cup-shaped cylinder cap 7 is positioned inwardly of case cap 6 and extends across the central opening in the case cap. Cylinder cap 7 is provided with a pair of inwardly extending side flanges 8 which are mounted on rod 9 that extends across the keyway 4 and is attached to the walls of cylinder 2. As shown in FIG. 1 and 2, cylinder cap 7 is provided with an elongated opening 10 which is aligned with keyway 4 in cylinder 2.

To provide a weather seal for the lock, a shutter 11 is mounted against the inner surface of cylinder cap 7 and acts to close off opening 10 when the key 5 is removed from the lock. As best shown in FIG. 1, shutter 11 is provided with a pair of side flanges 12 which are pivotally mounted on rod 9. Torsion spring 13 is disposed around rod 9 and serves to urge shutter 11 to a closed position. As shown in FIG. 2, one end 14 of torsion spring 13 is engaged with the inner surface of cylinder cap 7, while the opposite end 15 of torsion spring 13 is engaged with the inner surface of shutter 11. With this construction, the force of the spring will urge the shutter 11 to a closed position to thereby provide a weather seal for the key opening 10. By inserting key 5 into opening 10, the shutter 11 will be pivoted inwardly to permit entry of the key, as shown in FIG. 1.

In accordance with the invention, cylinder 2 is provided with a pair of parallel guideways 16 and 17 which intersect keyway 4, and a pair of tumbler plates 18 and 19 is mounted for sliding movement within each of the guideways 16 and 17. As best illustrated in FIG. 3, each of the tumbler plates 18 and 19 is formed with a central aperture 20 and the apertures 20 are in registry with keyway 4.

The ends 21 of tumbler plates 18 and 19 are rounded, as shown in FIG. 3, to conform to the curvature of the inner wall of cylinder 2.

In addition to the central aperture 20, each tumbler plate 18,19 is provided with an elongated opening 22, and the openings in tumbler plates in each pair are aligned, as best illustrated in FIG. 4. A compression spring 23 is mounted within the aligned openings of each pair of tumbler plates and the axis of the spring is disposed parallel to the respective guideways 16,17. As illustrated in FIGS. 3 and 4, each spring 23 bears against the ends of the respective openings 22 and also bears against shoulders 24 and 25 formed in cylinder 2 adjacent the guideways 16 and 17. Engagement of each spring 23 with the fixed shoulders 24 and 25 will maintained the tumbler plates 18 and 19 in a pre-set neutral position when the key 5 is removed from the keyway 4.

When the key 5 is inserted within the keyway 4, the bits 26 on opposite edges of the key will serve to move the tumbler plates 18 and 19 of each pair relative to each other, thereby compressing the springs 23, as shown in FIG. 5. Corresponding side edges of tumbler plates 18 and 19 are provided with V-shaped notches 27 and when the key is inserted in the lock, the tumbler plates 18 and 19 will be moved by the key bits 26 to an operative position where the notches 27 are in alignment. The aligned notches 27 are adapted to receive side bar 28 which is mounted for sliding movement within passage 29 in cylinder 2. As best shown in FIG. 3, the inner end of side bar 28 is provided with a V-shaped configuration 30 which mates with the aligned notches 27.

Sidebar 28 is urged inwardly by spring 31 which is located between legs 32 of the side bar and is interposed between base 33 and a spring retainer 34 which is secured to the inner wall of cylinder 2. In the locked condition, with the key removed from the keyway, side bar 28 will be in an outer locking position in which the outer ends of legs 2 will engage an internal recess 35 in casing 1 to thereby prevent rotation of cylinder 2 within casing 1.

With the key 5 removed from keyway 4, springs 23 maintain the tumbler plates 18 and 19 in the neutral position in which the apertures 20 in the tumbler plates are aligned with the keyway. In this condition, the notches 27 in the side edges of tumbler plates 18 and 19 are out of alignment so that the side bar 28 is in an outer locking position with the outer ends of legs 32 engaged with the recess 35 to prevent rotation of the cylinder within the casing 1.

When the double bitted, non-reversible key 5 is inserted within the keyway 4, the top of the key will engage the shutter 11, pivoting the shutter to an open position. The bits 26 of the key will then move the tumbler plates 18 and 19 in each pair relative to each other to compress the springs 23, as shown in FIG. 5. With the key fully inserted within the cylinder, notches 27 in the tumbler plates will be in alignment, enabling the V-edge 30 of side bar 28 to move inwardly into the aligned notches, under the force of spring 31, thereby unlocking the cylinder from the casing 1 and enabling the cylinder to be rotated.

On removal of key 5, springs 23 will extend moving the tumbler plates 18,19 to their original neutral position and engagement of the ends of the springs 23 with the respective shoulders 24 and 25 will retain the tumbler plates in the neutral position where the apertures 20 are in alignment with the keyway 4.

As the tumbler plates 18 and 19 are identical in size, additional key codes can be obtained by reversing one or both of the tumbler plates in the guideways.

The present invention provides a lock having the comparable security, key size, number of codes, and weather seal, as a conventional tumbler plate lock, but having a substantially shorter length, enabling the lock to be used in locations where the conventional lock cannot be utilized.

While the invention has been illustrated as using a side bar locking member, it is contemplated that the invention can be employed with other conventional cylinder-casing locking members.

Various modes of carrying out the invention are contemplated as being within the scope of the following claims particularly pointing out and distinctly claiming the subject matter which is regarded as the invention.

I claim:

1. A key operated lock, comprising an outer casing, a cylinder mounted for rotation within the outer casing and adapted to be connected to a working member, said cylinder including a central keyway, locking means for releasably locking the cylinder with respect to the casing, said cylinder having a guideway intersecting said keyway, a pair of tumblers disposed in side-by-side sliding movement within said guideway, each tumbler having an aperture aligned with said keyway, said tumblers having aligned openings separate from said apertures, biasing means disposed within the aligned openings with the force of said biasing means acting in a direction parallel to said guideway, said biasing means comprising a compression spring seated between the ends of the respective openings, the axis of said spring being parallel to said guideway, a pair of shoulders formed on said cylinder adjacent said guidways, one end of said spring engaged with one of said shoulders and the opposite end of said spring engaged with the other of said shoulders, a key to be received within the keyway and in said apertures, said key having at least one bit on opposite edges with said bits moving the tumblers relative to each other as the key is inserted within the keyway to thereby move said tumblers to an operative position, and means responsive to said tumblers being in said operative position for releasing said locking means whereby said cylinder can be rotated relative to said casing, engagement of said spring with said shoulder maintaining said tumblers in a neutral position when the key is withdrawn from said keyway.

2. The lock of claim 1, wherein each of said tumblers is provided with a notch, said notches being disposed in alignment when said tumblers are in said operative position, said locking means including a locking member movable between a locking position and a release position, said locking member being receivable within said aligned notches to thereby move said locking member from the locked position to the release position.

3. The lock of claim 2, and including second biasing means for urging said locking member to said release position.

4. The lock of claim 1, wherein said shoulders are positioned so that when said key is withdrawn said apertures will be aligned with said keyway.

5. The lock of claim 1, and including two pair of tumblers, said tumblers being generally flat plates, the tumblers of each pair being disposed in flatwise relation, said cylinder including a pair of guideways with each pair of tumblers being mounted within a corresponding guideway.

6. The lock of claim 1, wherein said bits are asymmetrical.

7. A key operated lock, comprising an outer casing, a cylinder mounted for rotation within the casing and adapted to be connected to a working member, said cylinder having a central keyway, said cylinder being provided with a pair of spaced guideways intersecting said keyway, a pair of tumbler plates disposed for sliding movement within each of said guideways, the tumbler plates of each pair being disposed in contiguous flatwise relation, each of said tumbler plates having an aperture aligned with said keyway, each of said tumbler plates being provided with an elongated slot, each of said slots being spaced inwardly from the periphery of the respective tumbler plate and having a pair of opposed ends, a spring disposed in the elongated slots of each pair of tumbler plates with the ends of the springs bearing against the ends of the respective slots, the axes of said spring being parallel to said guideways, a double bitted non-reversible key to be received within said guideway and having a plurality of bits on opposite edges, insertion of said key in said keyway causing the bits to move the tumbler plates of each pair relative to each other to compress said springs and move said tumbler plates into an operative position, a locking member operably connected to said tumbler plates and engageable with said outer casing to lock the cylinder to the outer casing, and means responsive to said tumbler plates being in said operative position for moving said locking member out of engagement with said casing to thereby permit said cylinder to rotate relative to said casing.

8. The lock of claim 7, wherein said apertures are located on the axis of said cylinder and said slots are offset from said axis.

9. A key operated lock, comprising an outer casing, a cylinder mounted for rotation within the casing and adapted to be connected to a working member, said cylinder having a central keyway, said cylinder being provided with a pair of spaced guideways intersecting said keyway, a pair of tumbler plates disposed for sliding movement within each of said guideways, the tumbler plates of each pair being disposed in contiguous flatwise relation, each of said tumbler plates having an aperture aligned with said keyway, a double bitted non-reversible key to be received in said keyway and in said aligned apertures, insertion of said key in said keyway causing the bits to move the tumbler plates of each pair relative to each other, a locking member operably connected to said tumbler plates and engageable with said outer casing to lock the cylinder to the outer casing, means responsive to said tumbler plates being in said operative position for moving said locking member out of engagement with said casing to thereby permit said cylinder to rotate relative to said casing, and resilient means operably connecting the tumbler plates of each pair with said cylinder for urging said tumbler plates to a neutral key-receiving position after removal of the key from said keyway.

* * * * *